US005649860A

United States Patent [19]

Giuffrida

[11] Patent Number: 5,649,860

[45] Date of Patent: Jul. 22, 1997

[54] DUCT AND METHOD FOR AIR-CONDITIONING

[75] Inventor: Giuseppe Giuffrida, Milan, Italy

[73] Assignee: Paolo Leonelli, Milan, Italy

[21] Appl. No.: 396,388

[22] Filed: Feb. 28, 1995

[30] Foreign Application Priority Data

Mar. 9, 1994 [IT] Italy ..... MI94A0432

[51] Int. Cl.[6] ..... F24F 13/072

[52] U.S. Cl. ..... 454/306; 239/533.13; 454/297

[58] Field of Search ..... 454/259, 284, 454/297, 303, 304, 306, 308; 239/533.13

[56] References Cited

U.S. PATENT DOCUMENTS

| | | | |
|---|---|---|---|
| 3,120,167 | 2/1964 | Kearny | 454/259 |
| 5,044,259 | 9/1991 | Catan et al. | 454/306 |

FOREIGN PATENT DOCUMENTS

| | | | |
|---|---|---|---|
| 216078 | 7/1908 | Germany . | |
| 916 249 | 7/1954 | Germany | 239/533.13 |
| 2 262 489 | 11/1973 | Germany | 454/306 |
| 2 323 138 | 11/1973 | Germany | 454/306 |
| 2607183 | 9/1976 | Germany . | |
| 25 08 865 | 9/1976 | Germany | 239/533.13 |
| 6601891 | 9/1966 | Netherlands . | |
| 929285 | 6/1963 | United Kingdom . | |
| 1176314 | 1/1970 | United Kingdom . | |

*Primary Examiner*—Harold Joyce
*Attorney, Agent, or Firm*—Guido Modiano; Albert Josif; Daniel O'Byrne

[57] ABSTRACT

A method of air-conditioning a space, including: delivering pressurized air into the space from a hollow body connected to a source of pressurized air, elastically flexing an elastic flap of the hollow body under an action of the pressurized air such that a passage section at the flap varies in size as a difference in pressure between the inside of the hollow body and the space being air-conditioned varies, automatically modulating a delivery speed of the pressurized air into the space so as to avoid unpleasant effects on occupants in the space being air-conditioned, reducing pressure losses at the delivery outlet of the hollow body, and reducing energy consumption required to air-condition the space.

19 Claims, 3 Drawing Sheets

DUCT AND METHOD FOR AIR-CONDITIONING

BACKGROUND OF THE INVENTION

The present invention relates to a duct with outlets for delivering a conveyed fluid, particularly for systems for air-conditioning civil or industrial premises. There is also disclosed a method of air-conditioning a space.

For conditioning civil or industrial premises ducts are used, which are embedded in the masonry of the buildings or placed outside the masonry, and by means of which the conditioning fluid, constituted by hot or cold air, is conveyed and distributed in the various areas of the rooms to be conditioned.

In particular, ducts are known which are constituted by tubes made of resin-treated fabric, are suspended at a certain height from the floor of the room, and have, along their extension, multiple fluid delivery outlets which are spaced one from another according to the requirements of the distribution of the fluid within the room.

Said delivery outlets are generally constituted by circular or square holes which are obtained by removing portions of the walls of the tubular body made of resin-treated fabric. In this manner, the delivery outlets have a fluid passage section that is constant and independent of the variation in the difference in pressure between the fluid inside the duct and the outside. Due to this fact, the conditions at which the fluid is delivered vary as the pressure of the fluid inside the duct varies. High pressures and high flow-rates of the fluid conveyed along the duct in fact lead to high speeds of the fluid delivered through the outlets; such speeds can be unpleasant for the occupants of the space being air-conditioned. On the other hand, this problem is not easy to solve since operating with larger outlets, which would have the advantage of reducing the fluid delivery speed, would cause the drawback of eliminating the effects of conditioning when the system must operate at low flow-rates and low pressures.

Another problem arising from delivery outlets provided as holes having a practically constant cross-section resides in the high load losses that occur in the fluid stream when it passes through said outlets. Vortical motions in fact occur at the sides that delimit the outlet and the fluid stream contracts as it leaves the outlet, leading to high pressure losses that negatively affect the operating costs of the system, since they entail additional energy consumption to compensate for them.

Another drawback that can be observed in ducts with delivery outlets constituted by circular or square holes is that it is impossible to deliver the fluid in a direction which is substantially at right angles to the longitudinal axis of the duct, since fluid delivery is unavoidably affected by the direction of the flow of the fluid inside the duct.

SUMMARY OF THE INVENTION

A principal aim of the present invention is to solve the drawbacks described above, providing a duct with delivery outlets that allow to deliver high fluid flow-rates but with very low pressure losses and thus with reduced energy consumption with respect to known ducts.

Within the scope of this aim, an object of the invention is to provide a duct with delivery outlets that is capable of reducing the fluid delivery speed at high flow-rates without however eliminating the effects of delivery at low flow-rates.

Another object of the invention is to provide a duct with delivery outlets that allow, if required, a particular orientation of the delivered fluid.

This aim, these objects, and others which will become apparent hereinafter are achieved by a duct with outlets for delivering the conveyed fluid, particularly for systems for air-conditioning civil or industrial premises, which comprises a hollow body that can be connected to a source of pressurized fluid and has, along its extension, at least one outlet for delivering said fluid, characterized in that said delivery outlet is delimited, along at least one of its sides, by a flap that can flex elastically due to the action of said fluid to vary the passage section of the fluid through said delivery outlet as the difference in pressure between the inside of said hollow body and the outside varies.

BRIEF DESCRIPTION OF THE DRAWINGS

Further characteristics and advantages of the invention will become apparent from the description of some preferred but not exclusive embodiments of the duct according to the invention, illustrated only by way of non-limitative example in the accompanying drawings, wherein.

DESCRIPTION OF THE PREFERRED EMBODIMENTS

Figure 1:
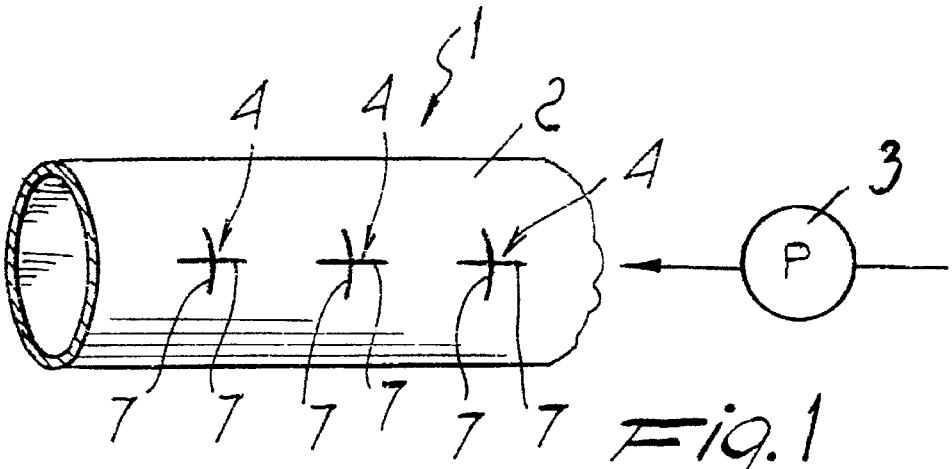
FIG. 1 is a schematic perspective view of a portion of a duct according to the invention, with three delivery outlets.

With reference to the above figures, the duct according to the invention, generally designated by the reference numeral 1, comprises a hollow body 2 which can be connected in a per se known manner to a source of pressurized fluid, such as for example a pump 3, by means of which the fluid to be conveyed is fed into the hollow body 2. Along the duct there is at least one delivery outlet 4 through which the fluid conveyed inside the hollow body 2 is delivered outside. According to the invention, said delivery outlet 4 is delimited, along at least one of its sides, by a flap that can flex elastically by virtue of the action of the fluid conveyed in the hollow body 2 in order to vary the passage section of the fluid through the delivery outlet as the difference in pressure between the inside of the duct and the outside varies.

Figure 2:
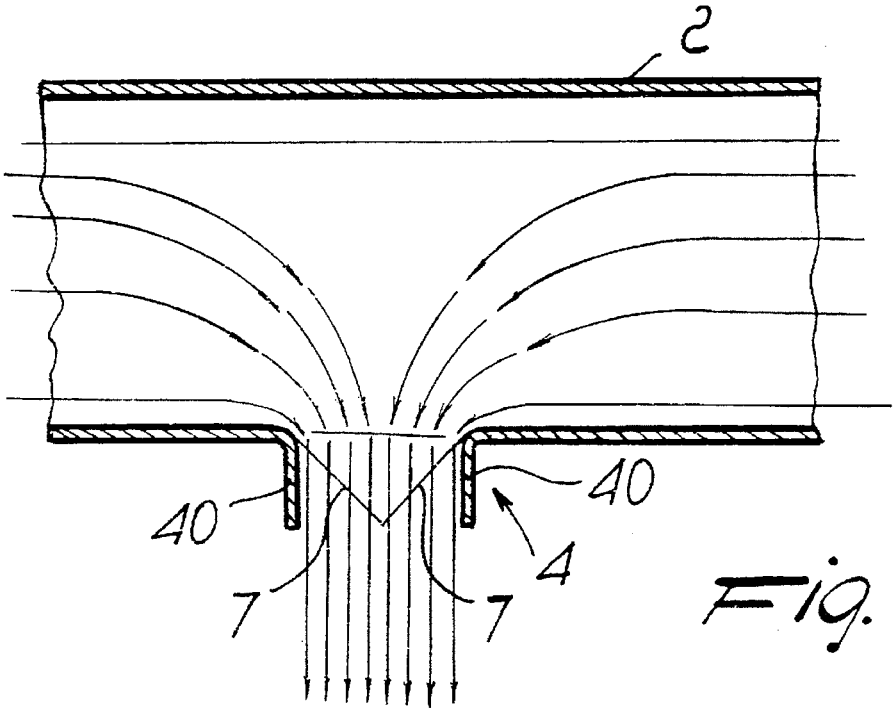
FIG. 2 is an enlarged-scale axial sectional view of a portion of the duct of FIG. 1, taken at a delivery outlet.
Figure 3:
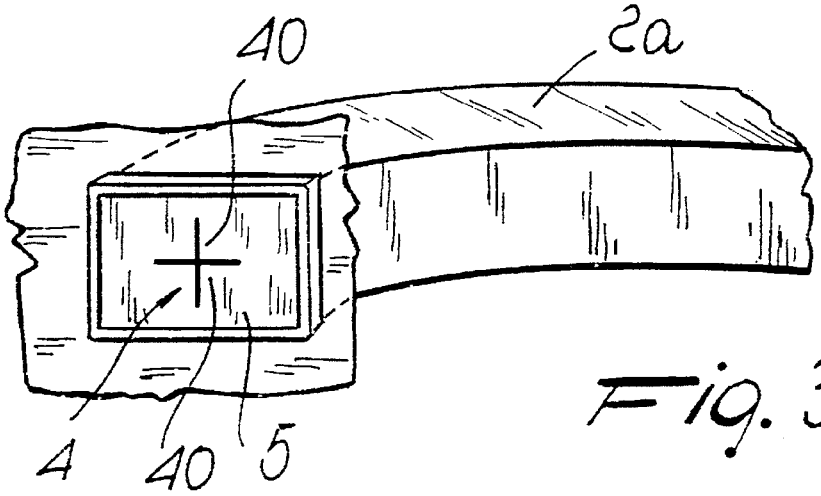
FIG. 3 is a view of a different embodiment of the duct according to the invention.

More particularly, the hollow body can be constituted by a tubular body made of resin-treated fabric, as shown in particular in FIGS. 1 and 2, or can be constituted by a rigid body, designated by the reference numeral **2*a* in FIG. 3**.

In any case, at the delivery outlets the hollow body has at least one portion that is made of elastically flexible material, and the delivery outlet is formed exactly in this portion made of elastically flexible material. If the hollow body is constituted by a tubular boby made of resin-treated fabric, elastic flexibility is ensured by the very material of which the hollow body is made, whereas if the hollow body is constituted by a rigid tubular body, a portion 5, constituted for example by a sheet made of elastically flexible material in which the delivery outlet is formed, will be provided.

Conveniently, the delivery outlet is formed by slits which are formed directly in the walls of the hollow body 2, if said body is made of elastically flexible material, or are formed in the portion 5 made of elastically flexible material which is applied to the hollow body 2*a*. These slits in practice form the delivery outlet with one or more perimetric elastically flexible flaps 40.

The slits may have various shapes and arrangements according to the requirements.

Figure 4:
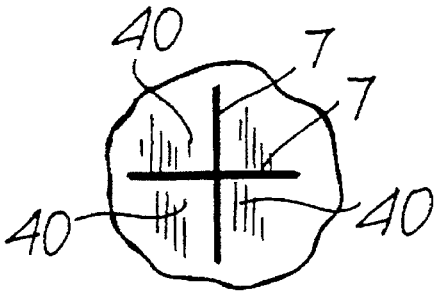
FIGS. 4 to 16 are views of various types of delivery outlet of the duct according to the invention.
Figure 5:
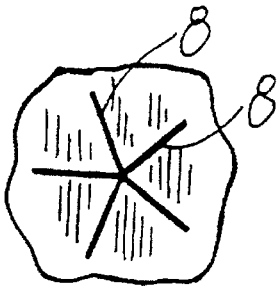

As shown in FIGS. 4 and 5, the delivery outlet can be formed by slits 7 and 8 that extend from a same point and are distributed symmetrically around said point.

Figure 6:
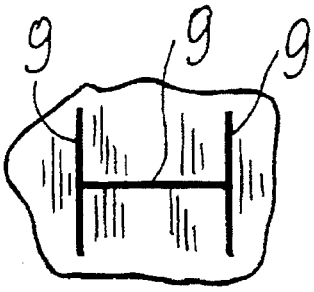

As shown in FIG. 6, the slits 9 can also be arranged symmetrically with respect to an axis rather than a point.

Figure 7:
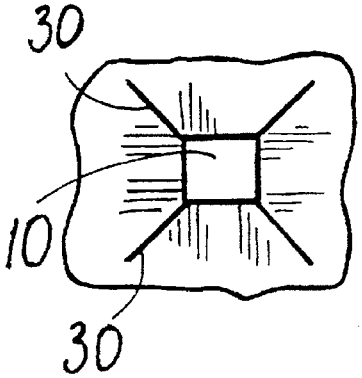
Figure 8:
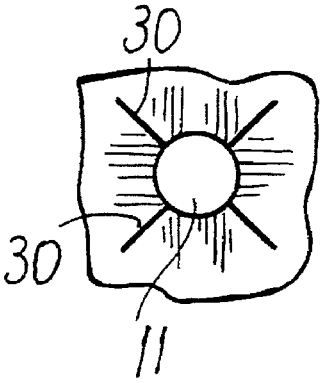
Figure 9:
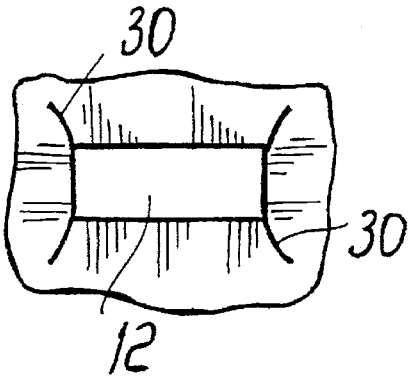

Furthermore, as shown in particular in FIGS. 7, 8, and 9, the slits 30 can start from a hole 10, 11, and 12 rather than from a point, and the hole may be circular, square, rectangular, and so forth.

Figure 10:
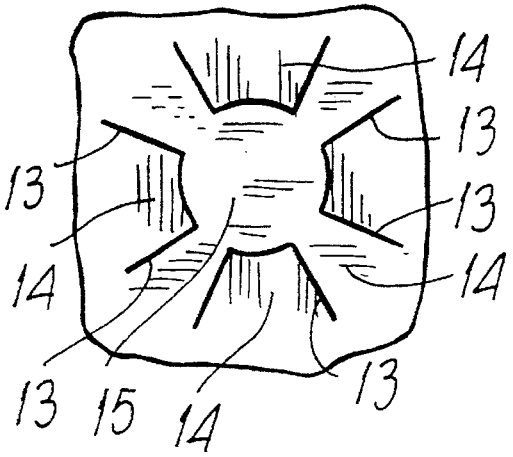

FIG. 10 illustrates a further embodiment of the outlet in the duct according to the invention. According to this embodiment, the outlet is formed by slits 13 which delimit sector-like flaps 14 that extend radially outwards from a circular region 15.

Figure 11:
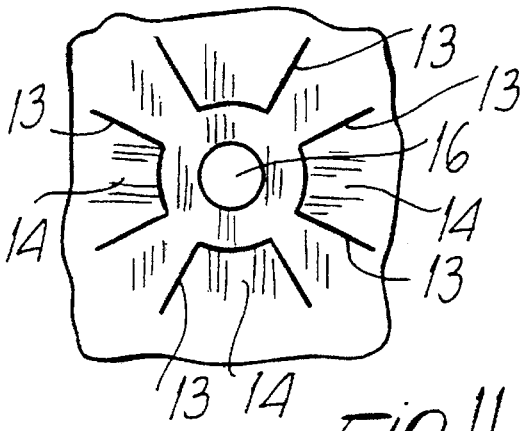

FIG. 11 illustrates still a further different embodiment, similar to the one shown in the preceding figure, in which a hole 16 is formed in the circular region 15.

Figure 12:
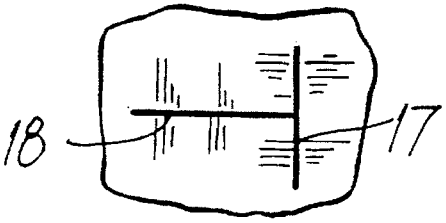

FIG. 12 illustrates another different embodiment of the outlet in the duct according to the invention, wherein the outlet is formed by two slits 17 and 18, one of which starts from the median point of the other.

Figure 13:
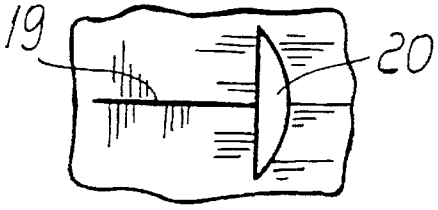

In FIG. 13, the outlet is formed by a slit 19 that runs from a median region of the straight side of a hole 20 shaped like a circular portion.

Figure 14:
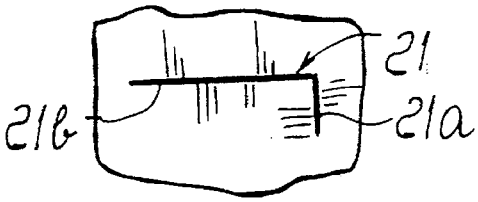

FIG. 14 illustrates an outlet which is simply constituted by a slit 21 with two portions 21*a* and 21*b* lying at right angles to each other.

Figure 15:
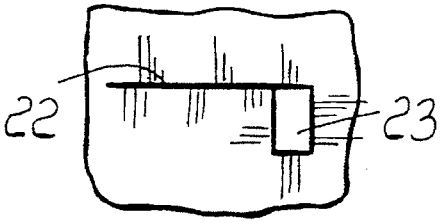

FIG. 15 illustrates an outlet which is constituted by a slit 22 that extends from the base of a rectangular hole 23.

Figure 16:
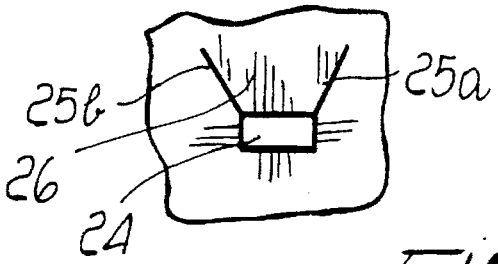

FIG. 16 illustrates an outlet which is constituted by a rectangular hole 24 with a flap formed by two slits 25*a* and 25*b* which run from two vertices of the hole 24 and delimit a flap 26 that affects a single side of the hole.

FIGS. 12 to 16 illustrate outlets which are constituted by slits which are asymmetrical, so as to obtain a different deformability of the sides of the outlet as the pressure of the fluid conveyed inside the duct varies.

The slits that form the delivery outlets can be provided using known technologies, such as for example punching, laser cutting, melting, molding, blanking, coupling, etcetera.

In practice, as shown in particular in FIG. 2, the outlets of the duct according to the invention can vary, by virtue of the elastic flexibility of the flap or flaps which are formed by the slits and affect one or more of their sides, the passage section of the fluid during delivery according to the difference in pressure between the fluid inside the duct and the outside. In this manner, when high flow-rates of fluid with high pressures must be delivered, the delivery outlet, under the thrust of the fluid itself, assumes the condition in which its passage section is largest, thus reducing the speed at which the fluid is delivered and avoiding unpleasant effects on the occupants of the air-conditioned space. Vice versa, when low flow-rates of fluid must be delivered, or when the fluid is conveyed along the duct at low pressure, the delivery outlet can have a reduced fluid passage section, so as to still allow the delivered fluid to reach the desired distances from the duct.

It should be noted that the flexibility of the flaps that delimit the delivery outlets also allows to significantly reduce losses at the perimetric sides of the delivery outlet, with advantages as regards energy consumption.

In practice it has been observed that the duct with delivery outlets according to the invention fully achieves the intended aim, since it automatically modulates the delivery speed of the fluid, reducing pressure losses at the delivery outlets, and thus reducing the energy consumption required to convey and distribute the fluid.

A further advantage of the duct with delivery outlets according to the invention is that it is possible to shape the outlets so that the configuration of the outlet varies as the pressure of the fluid inside the duct varies, thus allowing to orientate as required the flow of the fluid that leaves the duct.

Although the duct with delivery outlets according to the invention has been conceived in particular for systems for air-conditioning civil or industrial premises, it can nonetheless also be used for conveying and distributing any type of fluid in the gaseous or liquid phase or in a mixed liquid-gaseous phase at any temperature and pressure.

The duct with delivery outlets thus conceived is susceptible of numerous modifications and variations, all of which are within the scope of the inventive concept; all the details may furthermore be replaced with other technically equivalent elements.

In practice, the materials employed, as well as the contingent shapes and dimensions, may be any according to the requirements and the state of the art.

What is claimed is:

1. A method of air-conditioning a space, comprising the steps of:

providing a hollow body which defines a longitudinal extension and which encloses an inside space and which has a portion made of elastically flexible material;

providing at least one delivery outlet at said longitudinal extension of said body so as to define a passage section by providing slits in said portion made of elastically flexible material so as to form at least one elastically flexible flap located at said outlet and extending along at least one side of said passage section and such that said slits delimit said at least one elastically flexible flap along a perimeter of said delivery outlet;

arranging said delivery outlet at said space;

connecting said hollow body to a source of pressurized air such that pressurized air is conveyed in said inside space of said hollow body and delivered through said passage section to said space for air-conditioning said space;

elastically flexing said flap under an action of the pressurized air such that said passage section varies in size as a difference in pressure between said inside space and said space being air-conditioned varies whereby said delivery outlet has an increased passage section for high pressure differentials and said delivery outlet has a reduced passage section for low pressure differentials;

automatically modulating a delivery speed of the pressurized air through said passage section into said space being air-conditioned so as to avoid unpleasant effects on occupants in said space being air-conditioned; and reducing pressure losses at said delivery outlet and reducing energy consumption required to convey the pressurized air in said inside space of said hollow body and to delivery the pressurized air through said passage section and to air-condition said space.

2. The method of claim 1, wherein the step of providing at least one delivery outlet comprises providing slits extending from a same point.

3. The method of claim 1, wherein the step of providing at least one delivery outlet comprises providing slits extending from a perimeter of a hole.

4. The method of claim 1, wherein the step of providing at least one delivery outlet comprises providing slits forming sector-shaped flaps which are distributed around a circular region.

5. The method of claim 1, wherein the step of providing at least one delivery outlet comprises providing slits forming sector-shaped flaps which are arranged around a circular region that is crossed by a hole.

6. The method of claim 1, wherein the step of providing at least one delivery outlet comprises providing slits distributed symmetrically with respect to a point.

7. The method of claim 1, wherein the step of providing at least one delivery outlet comprises providing slits distributed symmetrically with respect to an axis.

8. The method of claim 1, wherein the step of providing at least one delivery outlet comprises providing slits arranged asymmetrically so as to provide a different deformability of the sides of the delivery outlet as the pressure of said fluid varies.

9. The method of claim 1, wherein the step of providing a hollow body comprises providing a tubular body made of resin-treated fabric.

10. A method of air-conditioning a space, comprising the steps of:

providing a hollow body having an inside space and having a portion made of elastically flexible material;

providing at least one delivery outlet at said hollow body so as to define a passage section by providing slits in said portion made of elastically flexible material so as to form at least one elastically flexible flap located at said outlet and extending along at least one side of said passage section and such that said at least one slit delimit said at least one elastically flexible flap along a perimeter of said delivery outlet;

arranging said delivery outlet at said space;

connecting said hollow body to a source of pressurized air such that pressurized air is conveyed in said inside space of said hollow body and delivered through said passage section to said space for air-conditioning said space;

elastically flexing said flap under an action of the pressurized air such that said passage section varies in size as a difference in pressure between said inside space and said space being air-conditioned varies whereby said delivery outlet has an increased passage section for high pressure differentials and said delivery outlet has a reduced passage section for low pressure differentials;

automatically modulating a delivery speed of the pressurized air through said passage section into said space being air-conditioned so as to avoid unpleasant effects on occupants in said space being air-conditioned; and reducing pressure losses at said delivery outlet and reducing energy consumption required to convey the pressurized air in said inside space of said hollow body and to delivery the pressurized air through said passage section and to air-condition said space.

11. The method of claim 10 wherein the step of providing at least one delivery outlet comprises providing a plurality of slits extending from a same point.

12. The method of claim 10 wherein the step of providing at least one delivery outlet comprises providing a plurality of slits extending from a perimeter of a hole.

13. The method of claim 10 wherein the step of providing at least one delivery outlet comprises providing a plurality of slits forming sector-shaped flaps which are distributed around a circular region.

14. The method of claim 10 wherein the step of providing at least one delivery outlet comprises providing a plurality of slits forming sector-shaped flaps which are arranged around a circular region that is crossed by a hole.

15. The method of claim 10 wherein the step of providing at least one delivery outlet comprises providing a plurality of slits distributed symmetrically with respect to a point.

16. The method of claim 10 wherein the step of providing at least one delivery outlet comprises providing a plurality of slits distributed symmetrically with respect to an axis.

17. The method of claim 10 wherein the step of providing at least one delivery outlet comprises providing a plurality of slits arranged asymmetrically so as to provide a different deformability of the sides of the delivery outlet as the pressure of said fluid varies.

18. The method of claim 10 wherein the step of providing a hollow body comprises providing a tubular body made of resin-treated fabric.

19. A method of air-conditioning a space, comprising the steps of:

providing a hollow body having an inside space and having a portion made of elastically flexible material;

providing at least one delivery outlet at said hollow body so as to define a passage section by providing slit means in said portion made of elastically flexible material for forming at least one elastically flexible flap located at said outlet and extending along at least one side of said passage section such that said slit means delimit said at least one elastically flexible flap along a perimeter of said delivery outlet;

arranging said delivery outlet at said space;

connecting said hollow body to a source of pressurized air such that pressurized air is conveyed in said inside space of said hollow body and delivered through said passage section to said space for air-conditioning said space;

elastically flexing said flap under an action of the pressurized air such that said passage section varies in size as a difference in pressure between said inside space and said space being air-conditioned varies whereby said delivery outlet has an increased passage section for high pressure differentials and said delivery outlet has a reduced passage section for low pressure differentials;

automatically modulating a delivery speed of the pressurized air through said passage section into said space being air-conditioned so as to avoid unpleasant effects on occupants in said space being air-conditioned; and reducing pressure losses at said delivery outlet and reducing energy consumption required to convey the pressurized air in said inside space of said hollow body and to delivery the pressurized air through said passage section and to air-condition said space.

* * * * *